US011892215B2

(12) United States Patent
Gao et al.

(10) Patent No.: US 11,892,215 B2
(45) Date of Patent: Feb. 6, 2024

(54) HEAT PUMP UNIT AND CONTROL METHOD THEREOF, CONTROL DEVICE, HEAT PUMP SYSTEM, AND COMBINED SUPPLY SYSTEM

(71) Applicant: A. O. Smith (China) Water Heater Co. Ltd., Nanjing (CN)

(72) Inventors: Wenwei Gao, Nanjing (CN); Yufeng Jing, Nanjing (CN); Miao Chen, Nanjing (CN)

(73) Assignee: A. O. Smith Corporation, Milwaukee, WI (US)

( * ) Notice: Subject to any disclaimer, the term of this patent is extended or adjusted under 35 U.S.C. 154(b) by 0 days.

(21) Appl. No.: 17/681,895

(22) Filed: Feb. 28, 2022

(65) Prior Publication Data

US 2022/0275987 A1 Sep. 1, 2022

(30) Foreign Application Priority Data

Mar. 1, 2021 (CN) ..... 202110223517.7

(51) Int. Cl.
*F25B 49/02* (2006.01)
*F25B 30/02* (2006.01)

(52) U.S. Cl.
CPC ..... *F25B 49/02* (2013.01); *F25B 30/02* (2013.01)

(58) Field of Classification Search
CPC ..... F25B 30/02; F25B 49/02
See application file for complete search history.

(56) References Cited

U.S. PATENT DOCUMENTS

2012/0222440 A1* 9/2012 Matsui ..... F25B 13/00 62/159
2021/0041127 A1* 2/2021 Risbeck ..... F24F 11/62

FOREIGN PATENT DOCUMENTS

CN 114440352 A 5/2022

* cited by examiner

*Primary Examiner* — Nael N Babaa
(74) *Attorney, Agent, or Firm* — Michael Best & Friedrich LLP

(57) ABSTRACT

A control method for a heat pump unit includes acquiring a first output capability set when the heat pump unit reaches a first preset energy efficiency ratio set at a current ambient temperature; acquiring a total demand load demanded by an indoor area having a heating demand or a cooling demand; and causing the heat pump unit to operate in accordance with the first output capability set when the total demand load is smaller than the first output capability set.

26 Claims, 4 Drawing Sheets

HEAT PUMP UNIT AND CONTROL METHOD THEREOF, CONTROL DEVICE, HEAT PUMP SYSTEM, AND COMBINED SUPPLY SYSTEM

TECHNICAL FIELD

The present invention relates to the technical field of temperature regulation equipment, and in particular, to a heat pump unit and a control method thereof, a control device, a heat pump system and a combined supply system.

BACKGROUND

At present, the water outlet temperature of the heat pump unit in the market can not be adjusted adaptively according to the change of the required load. When the required load becomes large, the capacity of the unit does not meet the requirements. When the required load becomes small, the heat pump unit has a large amount of spare capacity, and operates at a low efficiency and starts and stops frequently.

SUMMARY OF THE INVENTION

In view of at least one of the above disadvantages, it is an object of the present invention to provide a heat pump unit and a control method thereof, a heat pump system, and a combined supply system, to realize energy-saving operation.

In order to achieve the above purpose, the present invention adopts the following technical solution:

a control method for a heat pump unit, comprising the following steps of:

acquiring a first output capability set when the heat pump unit reaches a first preset energy efficiency ratio set at a current ambient temperature;

acquiring a total demand load demanded by an indoor area having a heating demand or a cooling demand; and causing the heat pump unit to operate in accordance with the first output capability set when the total demand load is smaller than the first output capability set.

As a preferred embodiment, the first preset energy efficiency ratio set includes at least one value or at least a value range between a maximum energy efficiency ratio of 0.8 times and a maximum energy efficiency ratio of 1.2 times.

As a preferred embodiment, the first preset energy efficiency ratio set includes a maximum energy efficiency ratio.

As a preferred embodiment, the first preset energy efficiency ratio set is a first preset energy efficiency ratio range, correspondingly, the control method comprises:

acquiring a first output capability range when the heat pump unit reaches the first preset energy efficiency ratio range at a current ambient temperature; and causing the heat pump unit to operate in accordance with a minimum value of the first output capability range when the total demand load is smaller than the minimum value of the first output capability range.

As a preferred embodiment, the heat pump unit is caused to operate in accordance with the total demand load when the total demand load is greater than the minimum value of the first output capability range.

As a preferred embodiment, the heat pump unit is caused to operate in accordance with the total demand load or the first output capability range when the total demand load is within the first output capability range.

As a preferred embodiment, the heat pump unit is caused to operate in accordance with the total demand load when the total demand load is higher than the first output capability set.

As a preferred embodiment, the heat pump unit operates in accordance with the total demand load until the total demand load is smaller than the first output capability set, and then the heat pump unit is caused to operate in accordance with the first output capability set.

As a preferred embodiment, the first output capability set is acquired based on prestored output capability set data corresponding to a first preset energy efficiency ratio set at different ambient temperatures.

As a preferred embodiment, a sum of loads required for the indoor areas having a heating demand or a cooling demand is taken as the total demand load.

As a preferred embodiment, the heat pump unit has a compressor and a heat exchange module for exchanging heat between a refrigerant and water; the heat exchange module has a water outlet port and a water return port; wherein the control method further comprises:

shutting down the compressor when an actual return water temperature of the heat pump unit is not lower than a set return water temperature.

As a preferred embodiment, the heat pump unit further has a water pump for driving water to flow;

wherein the control method further comprises: shutting down the compressor and maintaining the water pump to operate when an actual return water temperature of the heat pump unit is not lower than a set return water temperature, and when there is an indoor area having a heating demand or a cooling demand.

As a preferred embodiment, the compressor is shut down, and the water pump is maintained to operate until an actual room temperature of the indoor area reaches or exceeds a set room temperature.

As a preferred embodiment, the compressor is started to operate in accordance with the first output capability set when a temperature difference between the actual return water temperature and the set return water temperature of the heat pump unit exceeds a predetermined return water temperature difference, and when there is an indoor area having a heating demand or a cooling demand.

As a preferred embodiment, a water outlet port of the heat exchange module is controllably communicated with an energy storage module for energy storage;

the control method comprises: communicating the water outlet port of the heat exchange module with the energy storage module when the load is smaller than the first output capability set when reaching a first preset energy efficiency ratio set at a current ambient temperature;

blocking the water outlet port of the heat exchange module from the energy storage module when the load is higher than the first output capability set when reaching a first preset energy efficiency ratio set at a current ambient temperature.

As a preferred embodiment, an energy storage module for storing energy is connected in series to the water return port of the heat exchange module.

A control method for a heat pump unit, the control method comprises: causing the heat pump unit to operate in accordance with an output capability set that is not lower than the output capability set when the heat pump unit reaches the first preset energy efficiency ratio set at the current ambient temperature, when there is a heating demand or a cooling demand and when it is necessary to cause the compressor of the heat pump unit to operate.

A control method for a heat pump unit, comprising the following steps of:

acquiring a first output capability set when the heat pump unit reaches a first preset energy efficiency ratio set at a current ambient temperature;

acquiring a total demand load demanded by an indoor area having a heating demand or a cooling demand; and causing the heat pump unit to operate in accordance with a second output capability set when the heat pump unit reaches a second preset energy efficiency ratio set at the current ambient temperature, when the load is smaller than the first output capability set.

As a preferred embodiment, the first preset energy efficiency ratio set includes at least one value or at least a value range between a maximum energy efficiency ratio of 0.8 times and a maximum energy efficiency ratio of 1.2 times.

As a preferred embodiment, the second preset energy efficiency ratio set includes at least one value or at least a value range between a maximum energy efficiency ratio of 0.8 times and a maximum energy efficiency ratio of 1.2 times.

As a preferred embodiment, when the first preset energy efficiency ratio set is at least one value, the second preset energy efficiency ratio set is obtained by adding and/or subtracting a preset value into/from the first preset energy efficiency ratio set; and when the first preset energy efficiency ratio set is at least one value range, the second preset energy efficiency ratio set is a value range that coincides with at least a portion of the first preset energy efficiency ratio set.

A control device of a heat pump unit, comprising: the control device configured to execute the method as described in any of the above embodiments.

A heat pump unit, comprising a compressor for compressing a refrigerant, a heat exchange module for exchanging heat between the refrigerant and water, and the control device as described above.

A heat pump system, comprising the heat pump unit as described in the above embodiment, and a heat exchange end in communication with the heat pump unit.

A combined supply system, comprising the heat pump system as described in the above embodiment and a wall hung boiler unit, wherein the wall hung boiler unit is connected in series with a water inlet pipe or a water return pipe at a heat exchange end, or the wall hung boiler unit is connected in parallel with the heat pump unit to supply heat-exchange fluid to the heat exchange end.

The invention has the following beneficial effects:

In the control method of the heat pump unit provided in an embodiment of the invention, a first output capability set when the heat pump unit reaches a first preset energy efficiency ratio set at a current ambient temperature and a total demand load demanded by an indoor area having a heating demand or a cooling demand are acquired; and the heat pump unit is caused to operate in accordance with the first output capability set when the total demand load is smaller than the first output capability set, so as to cause the heat pump unit to operate with a first output capability set in a first preset energy efficiency ratio set when the total demand load is small, but not operate at low output capacity with a low energy efficiency, in this way, the operation energy efficiency of the heat pump unit is improved when the total demand load is small, and the energy-saving operation is realized.

Specific embodiment of the invention is disclosed in detail with reference to the following description and the accompanying drawings, indicating the manner in which the principles of the invention may be employed. It should be understood that the embodiment of the present invention is not thus limited in scope.

The features described and/or shown for one embodiment can be used in one or more other embodiments in the same or similar manner, can be combined with the features in other embodiments or replace the features in other embodiments.

It should be emphasized that, the term "include/contain" refers to, when being used in the text, existence of features, parts, steps or assemblies, without exclusion of existence or attachment of one or more other features, parts, steps or assemblies.

BRIEF DESCRIPTION OF THE DRAWINGS

In order to more clearly explain the embodiments of the invention or the technical solution in the prior art, drawings that need to be used in the description in embodiments or the prior art will be simply introduced below, obviously the drawings in the following description are merely some examples of the invention, for persons ordinarily skilled in the art, it is also possible to obtain other drawings according to these drawings without making creative efforts.

DETAILED DESCRIPTION OF THE PREFERRED EMBODIMENTS

In order to make those skilled in the art better understand the technical solutions in the present invention, the technical solutions in the embodiments of the present invention will be clearly and completely described in the following with reference to the accompanying drawings in the embodiments of the present application. Obviously, the described embodiments are only a part of the embodiments of the present invention, but not all of them. Based on the embodiments of the present invention, all other embodiments that are obtained by persons skilled in the art without making creative efforts shall fall within the protection scope of the present invention.

Unless otherwise defined, all technical and scientific terms used herein have the same meanings as that are generally understood by those skilled in the art belonging to the technical field of the present invention. The terms used herein in the description of the invention are for purposes of describing specific embodiments only and are not intended to limit the invention. The terms "and/or" as used herein include any and all combinations of one or more related listed items.

Figure 1:
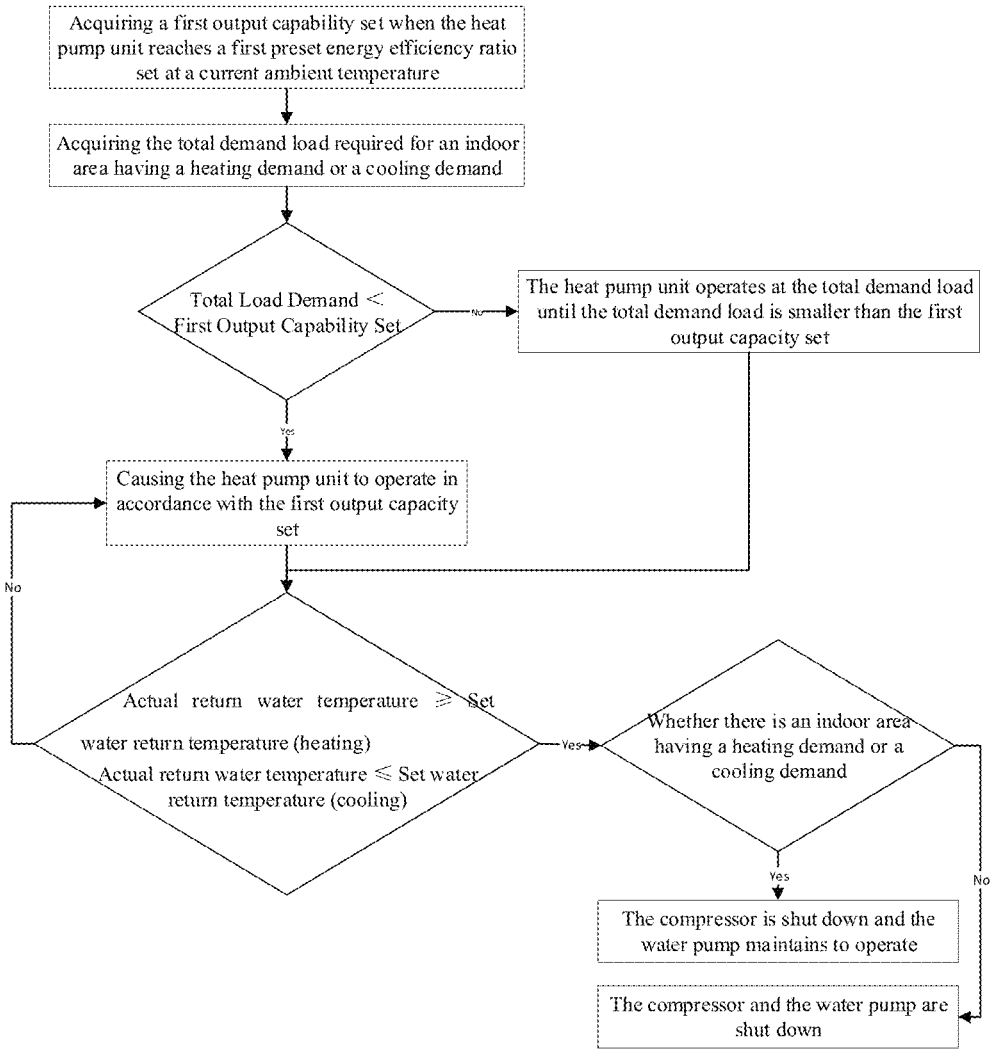
FIG. 1 is a flow schematic diagram of a control method of a heat pump unit according to an embodiment of the present invention.
Figure 2:
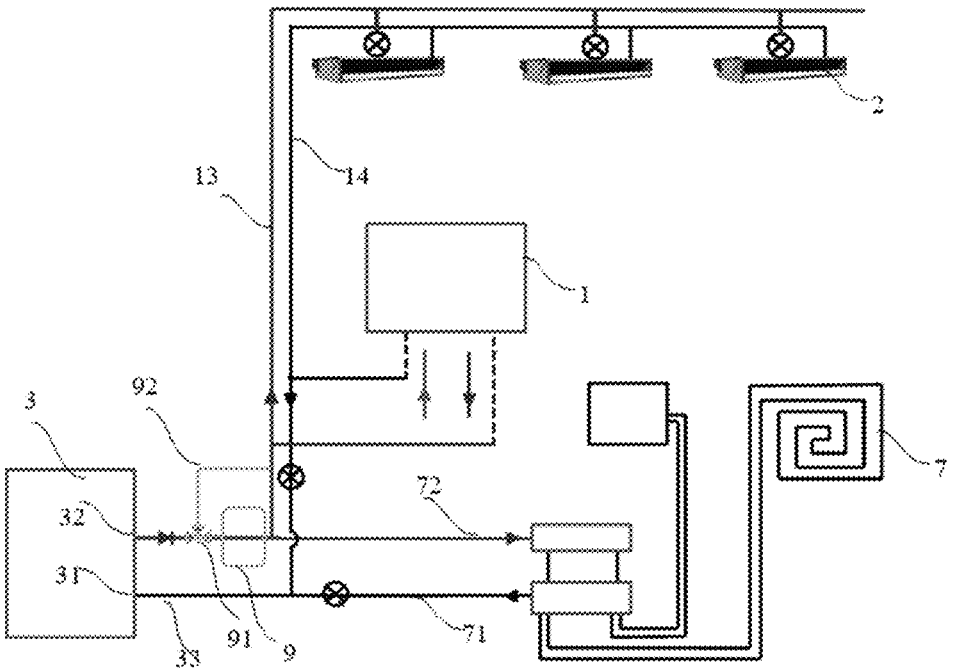
FIG. 2 is a schematic diagram of a waterway of a combined supply system according to an embodiment of the present invention.
Figure 3:
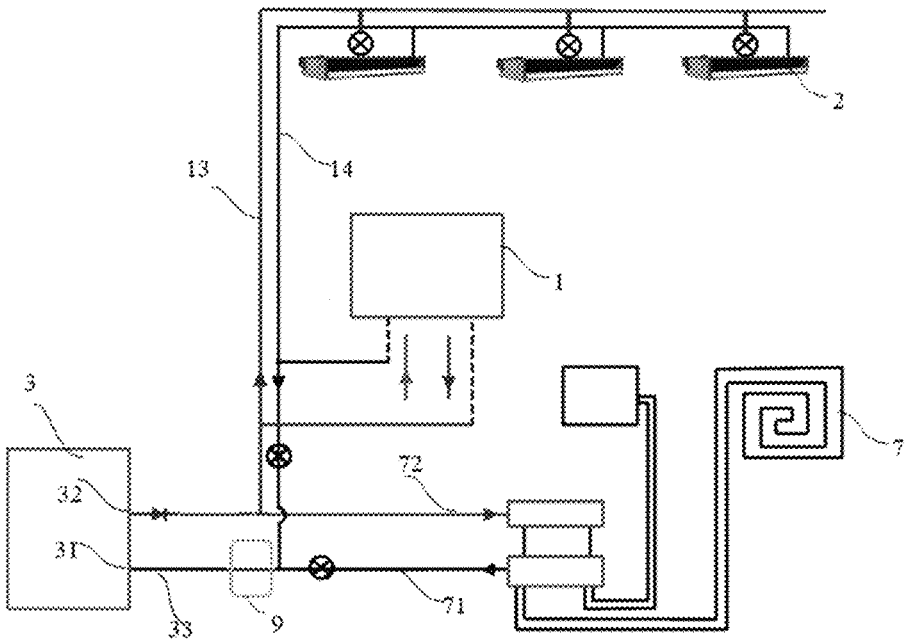
FIG. 3 is a schematic diagram of a waterway of a combined supply system according to another embodiment of the present invention.

Referring to FIGS. 1 to 3, an embodiment of the invention provides a control method for a heat pump unit 3, comprising:

a step S100: acquiring a first output capability set when the heat pump unit 3 reaches a first preset energy efficiency ratio set at a current ambient temperature;

a step S200: acquiring a total demand load demanded by an indoor area having a heating demand or a cooling demand;

a step S300: causing the heat pump unit to operate in accordance with the first output capability set when the total demand load is smaller than the first output capability set.

The heat pump unit 3 may include a heat pump module with a compressor and a heat exchange module. The heat pump module may be an outdoor unit of the heat pump unit 3. Specifically, the heat pump unit 3 has a compressor, an outdoor fan, and an evaporator. In an embodiment, the heat exchange module may also be integrated with the outdoor unit.

Further, as shown in FIG. 2 or 3, the heat pump unit 3 has a water outlet port 32 and a water return port 31. Specifically, the heat pump unit 3 has a compressor and a heat exchange module for exchanging heat between the refrigerant and the water. The heat exchange module has a water outlet port 32 and a water return port 31. The heat pump unit 3 further has a water pump for driving water to flow. The water pump is located on a circulating water path where the water outlet port 32 and the water return port 31 are located. The heat pump unit 3 can detect return water temperature and outlet water temperature via a temperature sensor (e.g., a water temperature sensor), and determines the outlet water temperature in accordance with a first output capability. The heat pump unit 3 starts and stops the compressor in accordance with the return water temperature.

The heat pump unit 3 detects the ambient temperature (outdoor temperature) by a temperature sensor (e.g., a temperature probe) located outdoors. Of course, the heat pump unit 3 can also obtain the local ambient temperature in real time via the network. The heat pump unit 3 may have a network module (e.g., a wife module, or a wired network module), which uses the Inter network to obtain the ambient temperature in real time.

The first preset energy efficiency ratio set may also be regarded as a better COP(Coefficient of Performance) set of the heat pump unit 3. The heat pump unit 3 can operate at the first preset energy efficiency ratio set to achieve a better efficiency.

In the step S100, the first output capability set is acquired based on prestored output capability set data corresponding to a first preset energy efficiency ratio set at different ambient temperatures. Wherein the pre-stored corresponding relationship data (the output capability set data corresponding to the first preset energy efficiency ratio set at different ambient temperatures) may be obtained under test conditions, or may be set according to experience. For example, the corresponding relationship data pre-stored in the control device of the heat pump unit 3 is shown in Table 1 below:

TABLE 1

| ambient temperature (° C.) | first preset energy efficiency ratio set | first output capability set (KW) |
|---|---|---|
| 2-5 | 3.8-4.5 | 7.4-10 |
| 5-7 | 4-5 | 7.5-10.5 |
| 7-10 | 4.2-5.5 | 8-11 |

According to the above Table, when there is a heating demand, when the temperature sensor detects that the current ambient temperature is 5.5° C., it is determined that when the output capability of the heat pump unit 3 is 7.5 kilowatts to 10.5 kilowatts, the heat pump unit 3 can achieve a better energy efficiency ratio, which may be between 4 and 5 at the present ambient temperature.

Of course, the first output capability (set) corresponding to different ambient temperatures may (only) be pre-stored in the control device (or storage medium) of the heat pump unit 3, the first preset energy efficiency ratio set may be considered as the energy efficiency ratio the heat pump 3 reached when operating at the first output capability (set), and thus the first preset energy efficiency ratio (set) may be selected whether to be pre-stored in the machine as desired.

Figure 5:
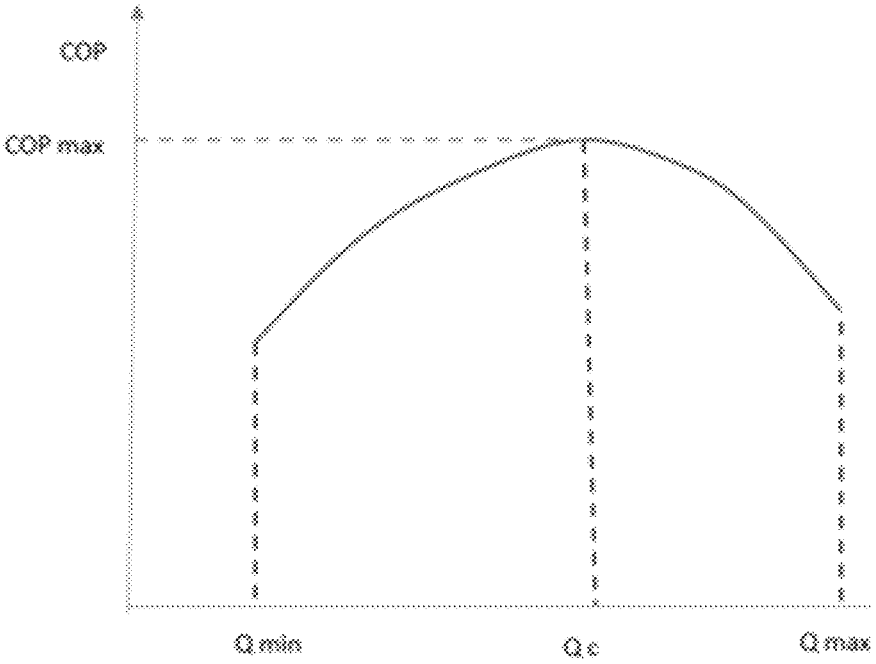
FIG. 5 is a graph of energy efficiency ratio versus output capability of the heat pump unit of FIG. 4 at a certain ambient temperature.

The energy efficiency ratio (COP) of the heat pump unit 3 has a corresponding relationship with the output capability. For example, the output capability (Q) versus the energy efficiency ratio (COP) at a certain ambient temperature is shown in FIG. 5. It can be seen that the maximum energy efficiency ratio (COPmax) is reached when the output capability is Qc. That is, the highest operating efficiency can be achieved by operating at Qc at this ambient temperature.

At different ambient temperatures, there is a corresponding relationship (curve) between the output capability of the heat pump unit 3 and the energy efficiency ratio. Accordingly, at different ambient temperatures, the heat pump unit 3 can operate efficiently by being set at an output capability corresponding to a better energy efficiency ratio.

The heat pump unit 3 reflects its output capability by controlling the water temperature of the output water. The heat pump unit 3 operates in accordance with the first output capability to produce a corresponding output water temperature which is an output result of the heat pump unit 3 operating in accordance with the first output capability (set). Furthermore, the first output capability set may also correspond to the (first) output water temperature set. Furthermore, the pre-stored data relationship may also be a corresponding relationship between the ambient temperature and the output water temperature, or corresponding relationships among the ambient temperature and output water temperature and a pump speed. Of course, the corresponding relationship (the corresponding relationship between the ambient temperature and the output water temperature) is also regarded as the corresponding relationship between the ambient temperature and the first output capability.

In this embodiment, the heat pump unit 3 can meet the heating or cooling demand of the user. An indoor area having a heating demand or a cooling demand may be an indoor area requiring temperature adjustment or maintenance. Specifically, the heat pump unit 3 is connected with heat exchange ends 2 and 7. Each of the heat exchange ends 2 and 7 corresponds to an indoor area where the temperature needs to be regulated. Further, the indoor area having a heating demand or a cooling demand can be judged according to whether or not there are heat exchange ends 2 and 7 to be operated. When there are heat exchange ends 2 and 7 to be operated for cooling or heating, it indicates that there is an indoor area having a heating demand or a cooling demand.

In the step S200, a sum of loads required for the indoor areas having a heating demand or a cooling demand is taken as the total demand load. When cooling, the load is the amount of heat that needs to be removed from the room in a unit time, and when heating, the load is the amount of heat supplied to the room in a unit time. Accordingly, the heating load or the cooling load may be calculated by adopting the existing calculation method, which is not described in detail in this embodiment.

In other embodiments, by the control method, the temperature differences between the indoor areas having a heating demand or a cooling demand may also be added up to obtain a total temperature difference by which a corresponding total demand load is obtained.

It should be noted that there is no clear sequential execution sequence between the step S100 and the step S200, wherein the step S100 may be performed before or after the step S200, of course, the two steps may also be executed concurrently, and this is not particularly limited in the embodiment of the present invention.

In the step S300, the total demand load is compared with the first output capability (set) to determine whether the current total demand load is within a better energy efficiency ratio range. When the total demand load is smaller than the first output capability set, if the operation is directly based on the total load demand, although the heating or cooling demand can be satisfied, the operation cannot be performed with a better energy efficiency ratio, and the loss is more. To avoid this problem, the operation is performed in accordance with the first output capability set, and the corresponding water temperature is output, which can not only meet the heating or cooling demand, but also enable the heat pump unit 3 to be in a better energy efficiency ratio to achieve the energy saving effect.

In the control method of the heat pump unit 3 provided in the embodiment, a first output capability set when the heat pump unit 3 reaches a first preset energy efficiency ratio set at a current ambient temperature and a total demand load demanded by an indoor area having a heating demand or a cooling demand are acquired; and the heat pump unit 3 is caused to operate in accordance with the first output capability set when the total demand load is smaller than the first output capability set, so as to cause the heat pump unit 3 to operate with a first output capability set in a first preset energy efficiency ratio set when the total demand load is small, but not operate at low output capacity with a low energy efficiency, in this way, the operation energy efficiency of the heat pump unit 3 is improved when the total demand load is small, and the energy-saving operation is realized.

In the case where the total demand load is greater than (or equal to) the first output capability (set), in order to avoid the drawback that it is difficult to meet the cooling or heating load demand by operating in accordance with the first output capability set, the control method further comprises a step S350 of causing the heat pump unit 3 to operate according to the total requirement load when the total demand load is greater than (or equal to) the first output capability (set).

Furthermore, when the total demand load is greater than (or equal to) the first output capability (set), the heat pump unit 3 operates in accordance with the total demand load until the total demand load is smaller than the first output capability set, and then the heat pump unit 3 is caused to operate in accordance with the first output capability set.

In the control method of the heat pump unit, the heat pump unit 3 operates at a better energy efficiency ratio according to the first output capability set corresponding to a first preset energy efficiency ratio set, so as to achieve the energy saving effect. Specifically, the first preset energy efficiency ratio set includes at least one value or at least a value range between a maximum energy efficiency ratio of 0.8 times and a maximum energy efficiency ratio of 1.2 times. The first preset energy efficiency ratio set may be either a single value (a point value) or a value range.

For the first output capability set corresponding to the first preset energy efficiency ratio set, in the case where the first preset energy efficiency ratio set is a single value, the first output capability set may be a single value or multiple values (for example, as can be seen from the graph of FIG. 5, one energy efficiency value may correspond to two capability values). If the first preset energy efficiency ratio set is a value range, the first output capability set is also a value range.

For example, in an embodiment, the first preset energy efficiency ratio set includes a maximum energy efficiency ratio. In this embodiment, as shown in FIG. 5, the optimum output capability (Qc) of the heat pump unit 3 at the maximum energy efficiency ratio (COPmax) at different ambient temperatures is tested, so as to pre-store the corresponding relationship data between the different ambient temperatures and the optimum output capability in the control device (such as a controller, PLC, a processor and etc.) of the heat pump unit 3. When it is necessary to operate the compressor of the heat pump unit 3, the heat pump unit 3 may be operated at an output water temperature not lower than that corresponding to the optimum output capability.

In another preferred embodiment, the first preset energy efficiency ratio set is a value range. Wherein the first preset energy efficiency ratio set is a first preset energy efficiency ratio range. Accordingly, the control method comprises: a step S101 of acquiring a first output capability range when the heat pump unit 3 reaches the first preset energy efficiency ratio range at a current ambient temperature; a step S200 of acquiring a total demand load demanded by an indoor area having a heating demand or a cooling demand; a step S300 of causing the heat pump unit 3 to operate in accordance with a minimum value of the first output capability range when the total demand load is smaller than the minimum value of the first output capability range.

In this embodiment, the heat pump unit 3 is caused to operate in accordance with the total demand load when the total demand load is greater than the minimum value of the first output capability range. Furthermore, the heat pump unit 3 is caused to operate in accordance with the total demand load or the first output capability range when the total demand load is within the first output capability range. In this case, the heat pump unit 3 can be operated at any value within the first output capability range, and this value can be artificially set and is pre-stored in the control device of the heat pump unit 3.

In this embodiment, the heat pump unit 3 is caused to operate in accordance with the total demand load when the total demand load is greater than the maximum value of the first output capability range. Specifically, the heat pump unit 3 operates in accordance with the total demand load until the total demand load is smaller than the first output capability set, and then the heat pump unit 3 is caused to operate in accordance with the first output capability set.

Continuing to refer to FIG. 1, in this embodiment, the control method further comprises: a step S400 of shutting down the compressor when an actual return water temperature of the heat pump unit 3 in a heating mode is not lower than a set return water temperature or the actual return water temperature in a cooling mode is not higher than the set return water temperature. Wherein, when the return water temperature exceeds the set return water temperature as desired, the compressor is shut down, and at this time, the water pump can be continuously operated to continuously heat or cool the room by the water in the circulating water path. Of course, the operation of the water pump may be judged according to whether or not the indoor temperature reaches the set temperature.

Furthermore, a step 401 of shutting down the compressor and maintaining the water pump to operate when an actual return water temperature of the heat pump unit 3 is not lower than a set return water temperature, and when there is an indoor area having a heating demand or a cooling demand. There is a heating demand or a cooling demand when the temperature of the indoor area needs to be adjusted or maintained at the target temperature. In this embodiment, the compressor is shut down when the actual return water temperature detected by the water temperature sensor reaches or exceeds the set return water temperature. When the actual indoor temperature does not reach the set indoor temperature, the water pump is maintained to operate. At this time, the water in the circulating water path is used to continuously adjust the indoor temperature until the indoor temperature reaches the set indoor temperature, thereby avoiding frequent starting and stopping of the compressor and improving the user experience.

Furthermore, the compressor is shut down, and the water pump is maintained to operate until an actual room temperature of the indoor area (all indoor areas where there is a need for cooling or heating) reaches or exceeds a set room temperature. Of course, when there is at least one indoor area having a heating demand or a cooling demand, the operation of the compressor is controlled according to the actual return water temperature, and the water pump is maintained in operation.

Of course, a fluctuating temperature difference (typically 1-2° C., even lower than 1° C.) is provided for the indoor area to maintain the set room temperature. During shutdown of the compressor and water pump, the actual room temperature gradually (undesirably) changes (increases when cooling is required or decreases when heating is required) until the temperature difference (actual temperature difference) between the actual room temperature and the set room temperature exceeds the fluctuating temperature difference, at this time, the steps S100 to S400 are performed again until the actual room temperature reaches or exceeds the set room temperature.

In order to restart the compressor for heating or cooling, when the temperature difference between the actual return water temperature of the heat pump unit 3 and the set return water temperature (actual return water temperature difference) exceeds a predetermined return water temperature difference, the compressor is started to operate in accordance with the first output capability set. To accurately restart the compressor (outdoor unit) and avoid starting the compressor by mistake, in this embodiment, in the control method, when it is also desirable to have an indoor area having a heating demand or a cooling demand in the condition that the actual return water temperature difference exceeds the predetermine return water temperature difference, the compressor is started to operate in accordance with the first output capability set.

For example, when the predetermined return water temperature difference (compressor start temperature difference) is 5° C., and the difference between the actual return water temperature and the set return water temperature is higher than 5° C., if the actual indoor temperature reaches the set indoor temperature at this time, it is unnecessary to restart the compressor, and correspondingly, the water pump can also be shut down. When the temperature difference between the actual indoor temperature and the set indoor temperature exceeds the predetermined temperature difference (there is a temperature regulation demand), and it is determined that there is a heating demand or a cooling demand, the compressor and the water pump are started to adjust or maintain the indoor temperature.

In this embodiment, the purpose of improving the energy efficiency is achieved by providing a first output capability set exceeding the total demand load of the room, wherein the first output capability set has energy that exceeds the total demand load of the room, and in order to avoid the waste of surplus energy and improve the energy utilization efficiency, the heat exchange module is further connected with an energy storage module 9. The energy storage module 9 may be an energy storage tank, in which an energy storing medium is stored. Specifically, the energy storage tank may be communicated in a waterway and stores energy internally by storing water.

The heat pump unit 3 can be applied to a combined supply system of the patent application entitled "Combined Supply System and Control Method thereof", with the application number 2020112186312, filed on Nov. 4, 2020.

As shown in FIG. 2 or 3, the water outlet port 32 of the heat exchange module may be a water outlet pipe that communicates with heat exchange ends 2 and 7 such as a fan coil 2, a floor heating coil 7, heating radiators and the like, and the water outlet port 31 may be a water return pipe that communicates with the heat exchange ends 2 and 7. Wherein, the water outlet pipe has a water outlet trunk and water outlet branches 13 and 72 communicating with respective heat exchange ends 2 and 7, and correspondingly the water return pipe has a water return trunk 33 and water return branches 14 and 71 communicating with respective heat exchange ends 2 and 7. The water outlet branches 13 and 72 and the water return branches 14 and 71 form a plurality of parallel branches connected in parallel between the water outlet trunk and water return trunk 33. Each parallel branch is provided with one or more heat exchange ends 2 and 7. The different heat exchange ends 2 and 7 are connected in parallel, so that the heat exchange ends 2 and 7 can be independently controlled.

In the embodiment as shown in FIG. 2, a water outlet port 32 of the heat exchange module is controllably communicated with an energy storage module 9 for energy storage. The energy storage module 9 is located in the circulating water path where the water pump is located. The energy storage module 9 is communicated to the water outlet trunk, and is connected in parallel with a bypass pipe 92 which can be connected or blocked. The water inlet end of the bypass pipe 92 is communicated upstream of the energy storage module 9, and the water outlet end thereof is communicated downstream of the energy storage module 9. The water inlet end of the bypass pipe 92 and the water inlet end of the energy storage module 9 (or the water inlet end of the pipe where the energy storage module 9 is located) are communicated to the water outlet port 32 of the heat exchange module through a three-way valve 91. The three-way valve 91 may be a three-way solenoid valve that is electrically controlled.

In this embodiment, in the control method, the water outlet port 32 of the heat exchange module is communicated with the energy storage module 9 when the load is smaller than the first output capability set when reaching a first preset energy efficiency ratio set at a current ambient temperature. At this time, the three-way valve 91 communicates the water inlet end of the energy storage module 9 with the water outlet port 32 by the action of the valve core, and blocks the water inlet end of the bypass pipe 92 from the water outlet port 32.

The water outlet port 32 of the heat exchange module is blocked from the energy storage module 9 when the load is higher than the first output capability set when reaching a first preset energy efficiency ratio set at a current ambient temperature. The three-way valve 91 blocks the water inlet end of the energy storage module 9 from the water outlet port 32 by the action of the valve core, and communicates the water inlet end of the bypass pipe 92 with the water outlet port 32.

In the embodiment as shown in FIG. 3, the energy storage module 9 for storing energy is connected in series to the water return port 31 of the heat exchange module. The energy storage module 9 is connected in series onto the water return trunk 33 to which the water return port 31 is connected. In this embodiment, it is not necessary to provide the bypass pipe 92 illustrated in FIG. 2. During the operation of the water pump, the energy storage module 9 can always remain in communication with the water return port 31.

Figure 4:
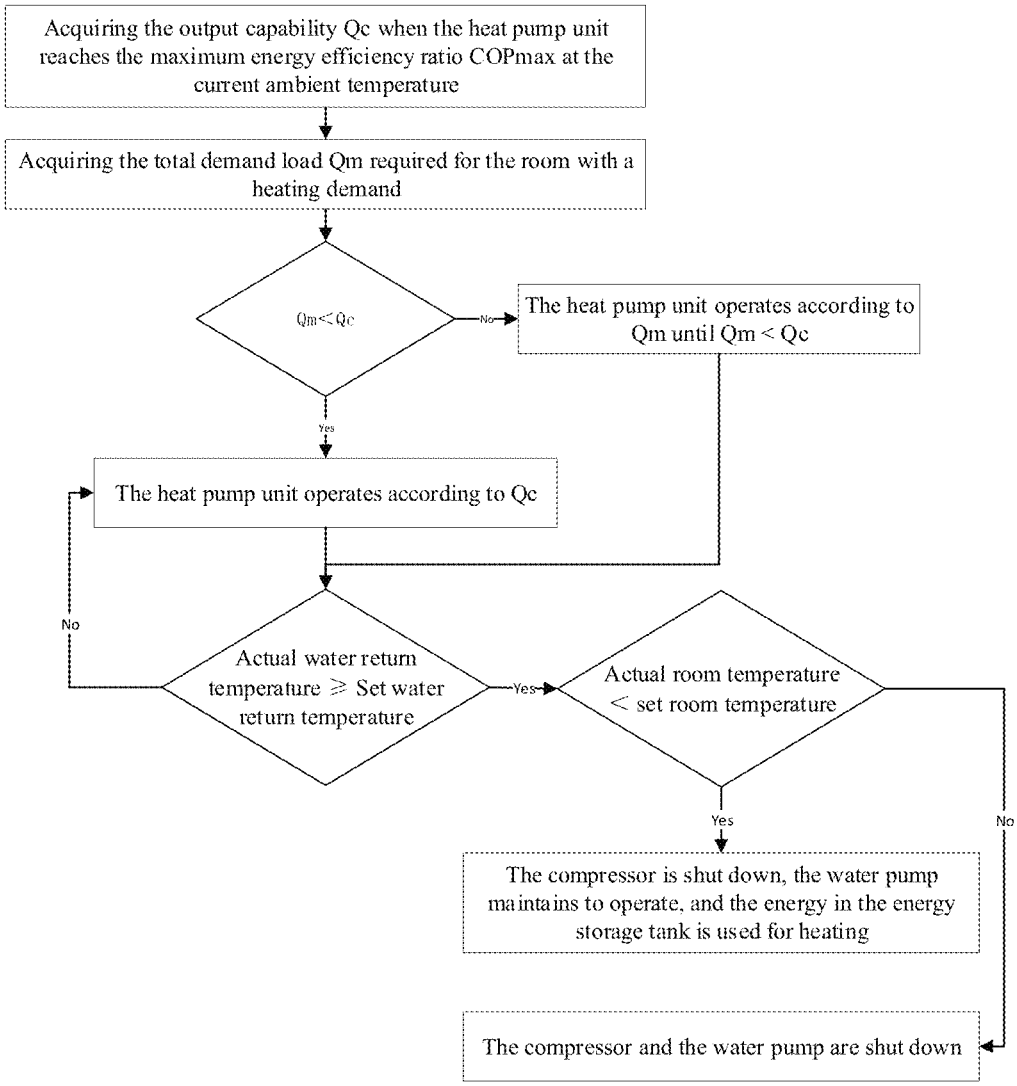
FIG. 4 is a flow schematic diagram of heat supplying by a control method of a heat pump unit according to an embodiment of the present invention.

Taking this embodiment as an example, the control method of the heat pump unit 3 in the heating mode according to a specific embodiment of the present invention will be described in detail with reference to FIGS. 3, 4, and 5, so as to better understand the invention.

After the user turns on the heating mode, the heat pump unit 3 obtains the output capability Qc when the maximum energy efficiency ratio COPmax is reached at the current ambient temperature, and obtains the total demand load Qm of all the rooms having the heating demand. If Qm>Qc, the heat pump unit 3 directly performs heating supply according to the water temperature output by the Qm operation. At this time, the heat pump module (such as a compressor, an outdoor fan and other outdoor units) of the heat pump unit 3 and the water pump of the heat exchange module are both in operation. The water outlet port 32 of the heat pump unit 3 outputs water at corresponding water temperature to the fan coil 2 through the water outlet pipe. The fan coil 2 supplies heating to the room, which enters the water return pipe (branches) via the fan coil 2 and then enters the water return trunk 33 and enters the energy storage tank for energy storage. The water in the energy storage tank flows out through the water return port 31 into the heat pump unit 3 again for heat exchange.

As the heating operation continues, Qm gradually decreases and when Qm<Qc, the heat pump unit 3 directly performs heating in accordance with the Qc operation. In this process, due to the large amount of heat required in the room, the actual return water temperature of the heat pump unit 3 is always lower than the set return water temperature, the compressor and the water pump need to be continuously operated.

With the continuous operation of the heating, the heat demand of the room gradually decreases, the water temperature output according to Qc has far exceeded the load demand of the room, and the excess energy can also be gradually stored in the energy storage tank. When the actual return water temperature reaches the set return water temperature, it indicates that the energy of the energy storage tank is fully stored, and at this time, the compressor is stopped and the water pump is maintained operating. The room is heated by the energy in the circulating water path (mainly the energy storage tank) until the actual room temperature reaches the set room temperature, or the room heating demand may be met by maintaining the water pump to operate.

When the temperature difference between the actual return water temperature and the set return water temperature exceeds the set return water temperature difference, it indicates that the energy in the energy storage tank has been used up. At this time, the above control flow is executed again, so that the actual room temperature can be maintained at the set room temperature required by the user.

Of course, if Qm is smaller than Qc when the heat pump unit is turned on to perform heating, the heating pump unit 3 directly performs heating in accordance with the Qc operation.

An embodiment of the invention further provides a control method for a heat pump unit, the control method comprises: causing the heat pump unit to operate in accordance with an output capability set that is not lower than the first preset energy efficiency ratio set that the heat pump unit reaches at the current ambient temperature, when there is a heating demand or a cooling demand and when it is necessary to cause the compressor of the heat pump unit to operate.

The invention further provides a control method of a heat pump unit, comprising: a step S100' of acquiring a first output capability set when the heat pump unit reaches a first preset energy efficiency ratio set at a current ambient temperature; a step S200' of acquiring a total demand load demanded by an indoor area having a heating demand or a cooling demand; and a step S300' of causing the heat pump unit to operate in accordance with a second output capability set when the heat pump unit reaches a second preset energy efficiency ratio set at the current ambient temperature, when the total demand load is smaller than the first output capability set.

The first output capability set may be different from or the same as the second output capability set. The heat pump unit can achieve a better energy efficiency ratio when operating under the first output capability set or the second output capability set, so as to achieve the energy saving effect. The second output capability is greater than the total demand load. In this embodiment, the first preset energy efficiency ratio set includes at least one value or at least a value range between a maximum energy efficiency ratio of 0.8 times and a maximum energy efficiency ratio of 1.2 times. The second preset energy efficiency ratio set includes at least one value or at least a value range between a maximum energy efficiency ratio of 0.8 times and a maximum energy efficiency ratio of 1.2 times.

Further, when the first preset energy efficiency ratio set (the first output capability set) is at least one value, the second preset energy efficiency ratio set (the second output capability set) is obtained by the first preset energy efficiency ratio set added with and/or subtracted by a preset value. For example, when the first preset energy efficiency ratio set is a single value (the first preset energy efficiency ratio), the second preset energy efficiency ratio set may be any value within the preset range of the first preset energy efficiency ratio. When the first preset energy efficiency ratio set is at least one value range, the second preset energy efficiency ratio set is a value range that coincides with at least a part of the range of the first preset energy efficiency ratio set.

The first preset energy efficiency ratio set may be regarded as a judgment energy efficiency ratio set, and the corresponding first output capability set is a judgment output capability set. The second preset energy efficiency ratio set is an operation energy efficiency ratio set, and the corresponding second output capability set is an operation output capability set. The heat pump unit determines whether to operate according to the second output capability set reaching the second preset energy efficiency ratio set by judging the total demand load according to the first output capability set reaching the first preset energy efficiency ratio set.

In (the control device of) the heat pump unit, there may be pre-stored data corresponding to the ambient temperature, the first output capability set, and the second output capability set one by one. After the current ambient temperature is obtained, the first and second output capability sets can be obtained according to the pre-stored data. For example, the corresponding relationship data pre-stored in the control device of the heat pump unit is shown in Table 2 below:

TABLE 2

| ambient temperature (° C.) | first output capability (KW) | second output capability (KW) |
|---|---|---|
| 2-5 | 9 | 8.7 |
| 5-7 | 8.5 | 8 |
| 7-10 | 8.2 | 7.4-10.5 |

For example, when indoor heating is required, the current ambient temperature detected by the temperature probe of the outdoor unit is 6 degrees Celsius. The heat pump unit determines that the (judgment) output capability at the current ambient temperature is 8.5 kW, the operation output capability is 8 kW, and the total demand load to be provided for the heat exchange ends (such as a fan coil or heating radiators) to be heated indoors is 7.5 kW. In the case of 8.5 kW greater than 7.5 kW, the heat pump unit can operate at 8 kW capability.

The invention further provides a control device of a heat pump unit, comprising: the control device configured to execute the control method described in any one of the above embodiments.

The invention further provides a heat pump unit, comprising a compressor for compressing a refrigerant, a heat exchange module for exchanging heat between the refrigerant and water, and a control device. The control device may be the control device in the above-described embodiment.

The invention further provides a heat pump system, comprising a heat pump unit and a heat exchange end communicated to the heat pump unit. The heat pump unit in any of the above embodiments may be used. The heat exchange end can be a heating or cooling terminal such as a fan coil, a heating radiator, a ground heating coil, and etc.

As shown in FIG. 2 or FIG. 3, an embodiment of the present invention further provides a combined supply system, which comprises the heat pump system described in any of the above embodiments, and the wall hung boiler unit 1. Wherein, the wall hung boiler unit 1 is connected in series to the water inlet pipe or the water return pipe at the heat exchange end. In other embodiments, the wall hung boiler unit 1 is connected in parallel to the heat pump unit 3, to supply heat exchange fluid to the heat exchange ends 2 and 7. The water way diagram of the combined supply system may be as shown in FIG. 2 or FIG. 3.

Specifically, the combined supply system may be a combined supply system of the patent application entitled "Combined Supply System and Control Method thereof", with the application number 2020112186312, filed on Nov. 4, 2020, the entire disclosure of which are incorporated herein by reference.

Any numerical value referred to herein includes all values of a lower value and an upper value that are incremented by one unit from a lower limit value to an upper limit value, with an interval of at least two units between any lower value and any higher value. For example, if it is stated that the number of components or process variables such as temperature, pressure, time, etc., have a value from 1 to 90, preferably from 20 to 80, more preferably from 30 to 70, the purpose is to illustrate that the equivalents such as 15 to 85, 22 to 68, 43 to 51, 30 to 32 are also explicitly recited in the specification. For values smaller than 1, one unit is suitably considered to be 0.0001, 0.001, 0.01, 0.1. These are merely intended to be explicitly expressed examples, and it may be considered that all possible combinations of numerical values enumerated between the lowest value and the highest value are explicitly set forth in a similar manner in this specification.

Unless otherwise stated, all ranges include end points and all numbers between the end points. The "about" or "approximate" used with the range is suitable for both end points of the range. Thus, "about 20 to 30" is intended to cover "about 20 to about 30," including at least the indicated end points.

All articles and references disclosed, including patent applications and publications, are incorporated herein by reference for all purposes. The term "consisting essentially of" to describe a combination should include the elements, components, parts or steps determined and other elements, components, parts or steps that do not substantially affect the substantially novel features of the combination. The use of the terms "comprising" or "including" to describe combination of the elements, components, parts or steps herein also contemplates embodiments that consist essentially of such elements, components, parts or steps. The use of the term "may" herein is intended to illustrate that any of the described attributes that may be included are optional.

The plurality of elements, components, parts or steps can be provided by a single integrated element, component, part or step. Alternatively, the single integrated element, component, part or step may be divided into separate multiple elements, components, parts or steps. A disclosed "a" or "an" used to describe an element, a component, a part or a step does not mean to exclude other elements, components, parts or steps.

It should be understood that the above description is for purposes of illustration and not for purposes of limitation. Many embodiments and many applications other than the examples provided will be apparent to those skilled in the art from reading the above description. Accordingly, the scope of the present teachings should not be determined with reference to the above description, but should be determined with reference to the appended claims and the full scope of equivalents owned by these claims. The disclosure of all articles and references, including patent applications and publications, is incorporated herein by reference for purposes of completeness. The omission of any aspect of the subject matter disclosed herein in the foregoing claims is not intended to waive the subject matter and the inventor should not be deemed to have considered the subject matter as a part of the disclosed subject matter.

What is claimed is:

1. A control method for a heat pump unit, wherein the method comprises the steps of:

determining a current ambient temperature;

acquiring a first output capability set corresponding to the heat pump unit operating at a first preset energy efficiency ratio set at the current ambient temperature;

acquiring a total demand load demanded by an indoor area having a heating demand or a cooling demand;

comparing the first output capability set and the total demand load;

determining that the total demand load is smaller than the first output capability set; and causing the heat pump unit to operate in accordance with the first output capability set in response to determining that the total demand load is smaller than the first output capability set.

2. The control method according to claim 1, characterized in that, the first preset energy efficiency ratio set includes at least one value or at least a value range between a maximum energy efficiency ratio of 0.8 times and a maximum energy efficiency ratio of 1.2 times.

3. The control method according to claim 1, characterized in that, the first preset energy efficiency ratio set includes a maximum energy efficiency ratio.

4. The control method according to claim 1, wherein the first preset energy efficiency ratio set is a first preset energy efficiency ratio range, and wherein the control method further comprises:

determining that the heat pump unit reaches the first preset energy efficiency ratio range at a current ambient temperature;

acquiring a first output capability range in response to determining that the heat pump unit reaches the first preset energy efficiency ratio range at the current ambient temperature;

determining the total demand load is smaller than a minimum value of the first output capability range, and operating the heat pump unit in accordance with the minimum value of the first output capability range in response to determining that the total demand load is smaller than the minimum value of the first output capability range.

5. The control method according to claim 4, wherein the method further comprises:

determining the total demand load is greater than the minimum value of the first output capability range; and operating the heat pump unit in accordance with the total demand load in response to determining that the total demand load is greater than the minimum value of the first output capability range.

6. The control method according to claim 4, wherein the method further comprises:

determining the total demand load is within the first output capability range; and operating the heat pump unit in accordance with the total demand load or the first output capability range in response to determining that the total demand load is within the first output capability range.

7. The control method according to claim 1, wherein the method further comprises:

determining the total demand load is higher than the first output capability set; and operating the heat pump unit operate in accordance with the total demand load response to determining that the total demand load is higher than the first output capability set.

8. The control method according to claim 7, wherein the method further comprises:

operating the heat pump unit in accordance with the total demand load, determining the total demand load is smaller than the first output capability set after operating the heat pump unit in accordance with the total demand load; and operating the heat pump unit in accordance with the first output capability set in response to determining the total demand load is smaller than the first output capability set.

9. The control method according to claim 1, characterized in comprising acquiring the first output capability set based on prestored output capability set data corresponding to a first preset energy efficiency ratio set at different ambient temperatures.

10. The control method according to claim 1, characterized in comprising taking a sum of loads required for the indoor areas having a heating demand or a cooling demand as the total demand load.

11. The control method according to claim 1, wherein the heat pump unit has a compressor and a heat exchange module for exchanging heat between a refrigerant and water; wherein the heat exchange module has a water outlet and a water return port; and wherein the control method further comprises:

determining an actual return water temperature of the heat pump unit in a heating mode is not lower than a set return water temperature or determining the actual return water temperature in a cooling mode is not higher than the set return water temperature, and shutting down the compressor in response to determining that the actual return water temperature of the heat pump unit in the heating mode is not lower than the set return water temperature or determining the actual return water temperature in the cooling mode is not higher than the set return water temperature.

12. The control method according to claim 11, wherein the heat pump unit has a water pump for driving water to flow; and wherein the control method further comprises:

determining the actual return water temperature attic heat pump unit in the heating mode is not lower than the set return water temperature or determining the actual return water temperature in the cooling mode is not higher than the set return water temperature;

determining there is an indoor area having a heating demand or a cooling demand; and shutting down the compressor and maintaining the water pump to operate in response to: (i) determining the actual return water temperature of the heat pump unit in the heating mode is not lower than the set return water temperature or determining the actual return water temperature in the cooling mode is not higher than the set return water temperature, and (ii) determining the indoor area has the heating demand or the cooling demand.

13. The control method according to claim 12, wherein the method further comprises:

determining that an actual mom temperature of the in nor area reaches or exceeds a set room temperature; and shutting down the compressor and maintaining the water pump to operates in response to determining that the actual room temperature of the indoor area reaches or exceeds the set room temperature.

14. The control method according to claim 13, wherein the method further comprises:

determining a temperature difference between the actual return water temperature and the set return water temperature of the heat pump unit exceeds a predetermined return water temperature difference;

determining the indoor area has the heating demand or the cooling demand; and starting to operate the compressor in response to determining: (i) the temperature difference between the actual return water temperature and the set return water temperature of the heat pump unit exceeds the predetermined return water temperature difference, and (ii) the indoor area has the heating demand or the cooling demand.

15. The control method according to claim 11, wherein a water outlet of the heat exchange module is controllably communicated with an energy storage module for energy storage; and wherein the control method further comprises:

determining the total demand load is smaller than the first output capability set; and communicating the water outlet of the heat exchange module with the energy storage module in response to determining the total demand load is smaller than the first output capability set; or determining the total demand load is higher than the first output capability set; and blocking the water outlet of the heat exchange module from the energy storage module in response to determining the total demand load is higher than the first output capability set.

16. The control method according to claim 11, characterized in that, an energy storage module for storing energy is connected in series to the water return port of the heat exchange module.

17. The control method according to claim 1, wherein the method further comprises:

determining the heat pump unit reaches a second preset energy efficiency ratio set at the current ambient temperature;

determining the total demand load is smaller than the first output capability set; and operating the heat pump unit in accordance with the second output capability set in response to determining: (i) the heat pump unit reaches the second preset energy efficiency ratio set at the current ambient temperature, and (ii) the total demand load is smaller than the first output capability set.

18. The control method according to claim 17, characterized in that, the second preset energy efficiency ratio set includes at least one value or at least a value range between a maximum energy efficiency ratio of 0.8 times and a maximum energy efficiency ratio of 1.2 times.

19. The control method according to claim 17, wherein the method further comprises:

determining the first preset energy efficiency ratio set is at least one value, and in response to determining the first preset energy efficiency ratio set is at the least one value, obtaining the second preset energy efficiency ratio set by adding and/or subtracting a preset value into/from the first preset energy efficiency ratio set; or determining the first preset energy efficiency ratio set is at least one value range, and in response to determining the determining the first preset energy efficiency ratio set is at the least one value range, setting the second preset energy efficiency ratio set at a value range that coincides with at least a portion of the first preset energy efficiency ratio set.

20. The control method according to claim 17, characterized in that, the first preset energy efficiency ratio set includes at least one value or at least a value range between a maximum energy efficiency ratio of 0.8 times and a maximum energy efficiency ratio of 1.2 times.

21. A control method for a heat pump unit, wherein the control method comprises:

determining: (i) the heat pump unit reaches a first preset energy efficiency ratio set at a current ambient temperature; (ii) there is a heating demand or a cooling demand; and (iii) it is necessary to cause a compressor of the heat pump unit to operate; and operating the heat pump unit in accordance with an output capability set that is not lower than the output capability set in response to determining: (i) the heat pump unit reaches the first preset energy efficiency ratio set at the current ambient temperature; (i) there is a heating demand or a cooling demand; and (iii) it is necessary to cause the compressor of the heat pump unit to operate.

22. The control method according to claim 21, characterized in that, the first preset energy efficiency ratio set includes at least one value or at least a value range between a maximum energy efficiency ratio of 0.8 times and a maximum energy efficiency ratio of 1.2 times.

23. A control device of a heat pump unit, characterized in that, the control device is configured to execute the method according to claim 1.

24. A heat pump unit, characterized in comprising a compressor for compressing a refrigerant, a heat exchange module for exchanging heat between the refrigerant and water, and control device according to claim 23.

25. A heat pump system, characterized in comprising a heat pump unit according to claim 24, and a heat exchange end in communication with the heat pump unit.

26. A combined supply system, characterized in comprising the heat pump system according to claim 25 and a wall hung boiler unit, wherein the wall hung boiler unit is connected in series with a water inlet pipe or a water return pipe at a heat exchange end, or the wall hung boiler unit is connected in parallel with the heat pump unit to supply heat-exchange fluid to the heat exchange end.

* * * * *